US006730193B1

(12) United States Patent
Matula et al.

(10) Patent No.: US 6,730,193 B1
(45) Date of Patent: May 4, 2004

(54) WIRE PIT

(75) Inventors: Jouni Matula, Savonlinna (FI); Riitta Rahkonen, Kotka (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 10/049,680

(22) PCT Filed: Aug. 17, 2000

(86) PCT No.: PCT/FI00/00695

§ 371 (c)(1),
(2), (4) Date: Feb. 15, 2002

(87) PCT Pub. No.: WO01/14636

PCT Pub. Date: Mar. 1, 2001

(30) Foreign Application Priority Data

Aug. 20, 1999 (FI) ..... 19991779

(51) Int. Cl.[7] ..... D21F 1/06; D21F 1/66

(52) U.S. Cl. ..... 162/264; 162/336; 162/380; 162/DIG. 7

(58) Field of Search ..... 162/190, 264, 162/189, 252, 258, 259, 336, 337, 338, 348, 380, DIG. 11, DIG. 7; 95/248, 260; 96/155, 194

(56) References Cited

U.S. PATENT DOCUMENTS

| | | | | | |
|---|---|---|---|---|---|
| 865,168 | A | * | 9/1907 | Dohan | 162/190 |
| 1,629,607 | A | * | 5/1927 | Witham, Jr. | 162/189 |
| 1,629,701 | A | * | 5/1927 | Hass | 210/524 |
| 2,706,434 | A | * | 4/1955 | Elderkin | 162/264 |
| 2,748,670 | A | * | 6/1956 | Beachler | 162/264 |
| 3,801,436 | A | * | 4/1974 | Prechtel | 162/252 |

FOREIGN PATENT DOCUMENTS

| | | | | |
|---|---|---|---|---|
| GB | 2231504 | | 11/1990 | |
| JP | 54-082769 | * | 7/1979 | B01D/43/00 |
| WO | WO 98/27276 | | 6/1998 | |

* cited by examiner

*Primary Examiner*—Steven P. Griffin
*Assistant Examiner*—Eric Hug
(74) *Attorney, Agent, or Firm*—Nixon & Vanderhye, P.C.

(57) ABSTRACT

The present invention relates to a wire pit. A characteristic feature of the wire pit (50) according to the invention is that its wall/walls (52', 52", 54', 62) converge downwards so that the average flow direction of the liquid along the most part of the wire pit's (50) height deviates from vertical.

18 Claims, 4 Drawing Sheets

WIRE PIT

Figure 1:
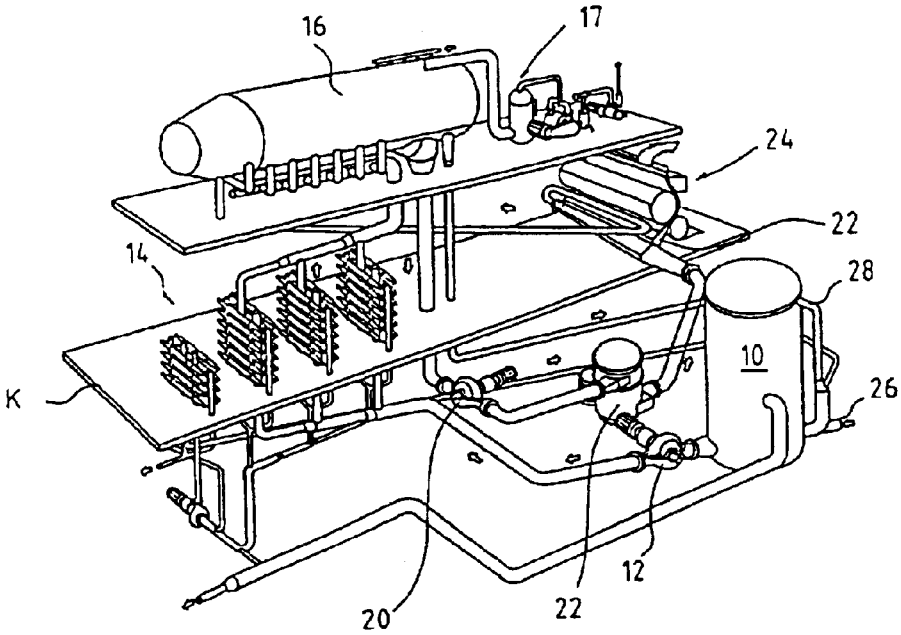
Fig. 1 (Prior Art)

This application is the U.S. national phase of international application PCT/F100/00695 filed Aug. 17, 2000, which designated the U.S.

The present invention relates to a wire pit. Especially preferably the invention relates to a new kind of wire pit construction having a wall/walls converging downwards so that the average flow direction of the liquid at the most part of the wire pit's height deviates from vertical.

Almost all prior art paper machine approach systems feeding paper pulp to the paper machine, which are well described e.g. in U.S. Pat. No. 4,219,340, comprise the following components: A white water tank, a centrifugal cleaning plant with feed pumps and pumps between various stages, a gas-separation tank with vacuum providing means, a head box feed pump, a head box screen, a paper machine head box and white water trays. Said components are placed in connection with the paper machine and arranged to operate as is follows. The fiber material used for paper making and the fillers which are diluted with so-called white water obtained from the wire section of the paper machine are dosed by means of a basis weight regulation valve from the machine chest into the white water tank usually located at the bottom level of the mill. By means of a feed pump also located at the bottom level of the mill, the fiber suspension is pumped from the white water tank to the first cleaning stage of a centrifugal cleaning plant usually located at the machine level, i.e. the location level of the paper machine, or, as in said patent, above it. The centrifugal cleaning plant most typically comprises several (most commonly 4–6) stages each typically having a feed pump of its own. By means of pressure created by said feed pump, the fiber suspension accepted in the first cleaning stage of the centrifugal cleaning plant is further conveyed to a gas-separation tank typically located at a level above the machine level. In the gas-separation tank, the fiber suspension is subjected to the effect of vacuum created by means of vacuum providing apparatus, most usually liquid rings pumps, whereby both part of the gas dissolved in the suspension and the gas existing in the suspension in small bubbles rises above the surface of the liquid in the tank and is discharged from the tank via the vacuum providing apparatus. From the gas-separation tank the fiber suspension, wherefrom gas has been removed as thoroughly as possible, flows to a head box feed pump located at the bottom level of the mill, which pump further pumps the fiber suspension to a head box screen (not shown in said U.S. patent) also located at the bottom level of the mill, whereafter the fiber suspension flows to the machine level into the head box of the paper machine.

One problem in the prior art paper machine approach system is its huge volume mostly due to the volume of the gas-separation tank and the centrifugal cleaning plant as well as the long and large-sized piping. Volume in itself is not a major problem, except for space requirement and being a relatively big investment, but long delays caused by great volumes substantially restrain the change of grade and result in great amounts of broke in connection with the changes of grade. In connection with the grade change, broke is formed of all the pulp being used to produce the final product before the relative amounts of all components of the fiber suspension have been equalized throughout the approach system to correspond to the content of the desired final product.

Said problem has already been dealt with in FI patent 89728, according to which different types of white waters are collected from the wire section of the paper machine and guided directly to the short circulation of the paper machine without employing any actual white water tank. In said publication, under each white water tray there is a pump for delivering the white water to a suitable location. The publication describes the white water channels to be very flat, i.e. of small volume, so that the delays remain as short as possible. In the solution according to said publication, arranged at the side of the wire section there is a small pumping container and means providing pumping operation, from which the white water is further delivered to the process. The deaeration reached by means of this apparatus is not efficient enough to provide undisturbed operation of the paper machine, though. In other words, despite the possibility of removing gas from white waters by means of a pumping device according to the publication, this has not succeeded to an extent allowing for eliminating the wire pit, i.e. the white water tank, assisting in the gas-separation.

Thus, despite progressive proposals in order to eliminate the wire pit, one still has to accept the presence of the wire pit in the paper machine approach system. Nevertheless, one does not have to accept the great height of the white water tank to be a reason to the energy consumption of pumping in the paper machine approach system. The white water tanks, into which the so-called white waters from the paper machine are collected, have traditionally been relatively big containers having a height of almost ten meters, located at the bottom level of the paper mill. The surface level of these tanks, although keeping constant in an individual tank mostly due to overflow, has been greatly altering in relation to the paper machine. One reason for the altering of the surface level is the location of the white water tank in connection with the machine. In case of a so-called fourdrinier machine, the white water tank, which in said case is also referred to as wire pit, is located below the wire section, whereby its surface level has been relatively low, due to e.g. constructional reasons. Also, the surface level of a white water tank arranged aside the wire section or the like (a so-called off-machine silo) is not always as high as it might in practice be. The big size of the white water tank has been justified on the basis that the presence of a big buffer tank has been considered a positive factor stabilizing the process. This has also caused both some extra energy consumption, as the first feed pump has had to compensate for the sometimes-low surface level of the white water tank, and additional delays in the process caused by the big volume of the white water tank.

In the way according to the FI application 981798, it is possible to avoid locating said white water tank in the paper machine approach system at the bottom level of the mill, i.e. below the machine level. The solutions described in said application allow for arranging the white water tank at the machine level, whereby the gas-separation tank feed pump aside the white water tank is also located at the machine level.

However, said publication mainly concentrates on the possibility of decreasing the energy consumption of pumping by utilizing a propeller pump located at the machine level. Said publication only mentions that at the same time it is also possible to decrease the height of the wire pit and accordingly decrease the time needed for changes of grade.

The present invention handles with problems related to the construction of a low wire pit and different factors, which have to be taken into account when designing a wire pit.

Firstly, as already stated above, the wire pit must operate as a vessel separating gas from the white waters, whereby the same rules that apply to other vessels used for gas-separation apply to the construction of the wire pit as well, that is the open liquid surface must be as large as possible. A good starting point may be e.g. that the cross-section of the wire pit is kept essentially unchanged.

Secondly, the liquid flow into the wire pit must be kept as laminar as possible in order not to disturb the gas-separation. Further, because various white waters, i.e. for example having various fiber contents, enter the wire pit, the liquids should have to be directed into the wire pit in such a way that the cleanest fraction of the white waters would be directed to the overflow of the wire pit.

Thirdly, both the liquid entering the wire pit and the liquid discharged therefrom should be as non-turbulent as possible, so that the turbulence would not hamper the separation of gases from the white waters and the mixing of thick pulp in the white water in the wire pit discharge.

In addition to that, as a wire pit of small volume is practically in every respect better and more practical than one of great volume, it should be possible to locate a small-volume wire pit in an older paper machine approach system as well, that is in an apparatus where both the mixing pump and the mixing of thick stock and chemicals are arranged at the bottom level of the mill. To put it differently, the ideal construction of a wire pit would be a construction that could be modified as easily as possible in relation to flows going to and from various locations and, in addition to that, arranged in new systems at the machine level of the mill and in older systems at the bottom level of the mill.

A preferable solution according to the present invention is a wire pit made of modules in such a way that its parts may be located in several various positions in relation to each other.

Characterizing features of the wire pit according to the invention are described in the appended claims.

Figure 2:
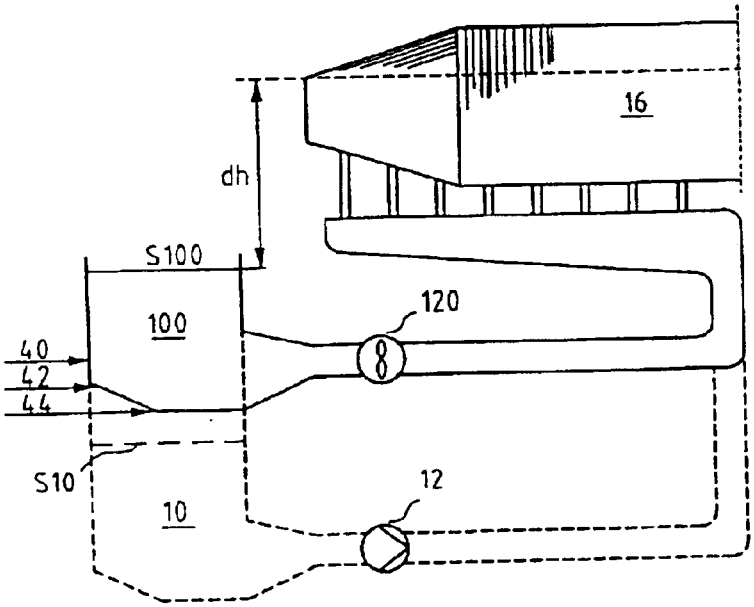
Figure 3:
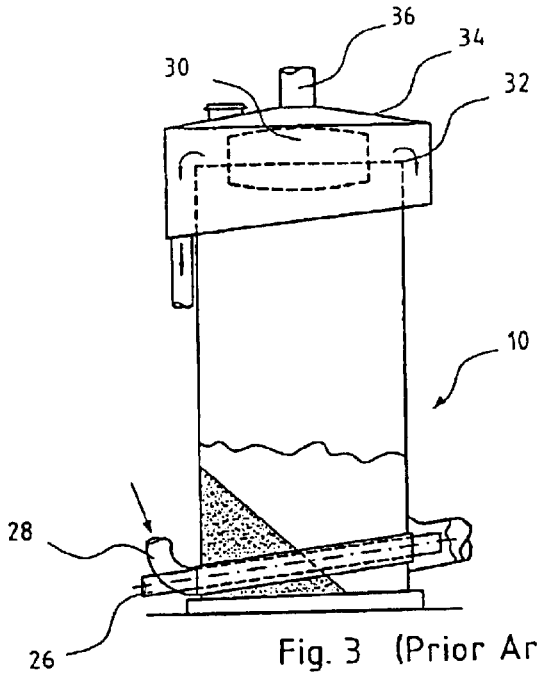
Fig. 3 (Prior Art)
Figure 4:
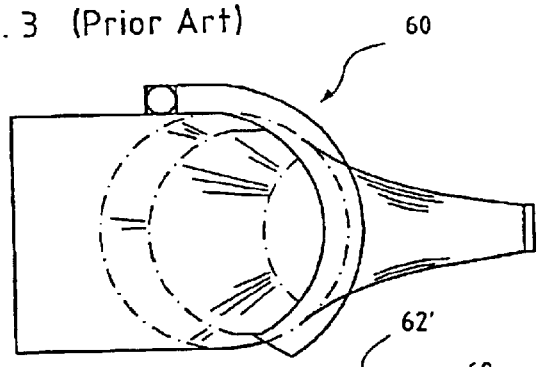
Figure 5:
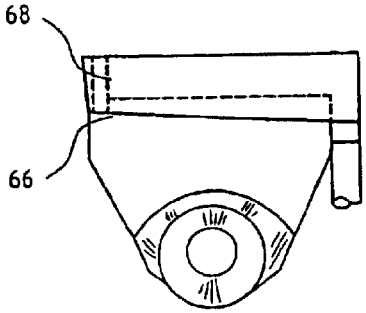
Figure 6:
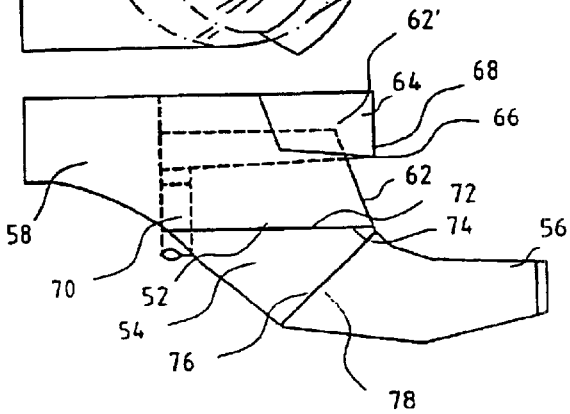
Figure 7:
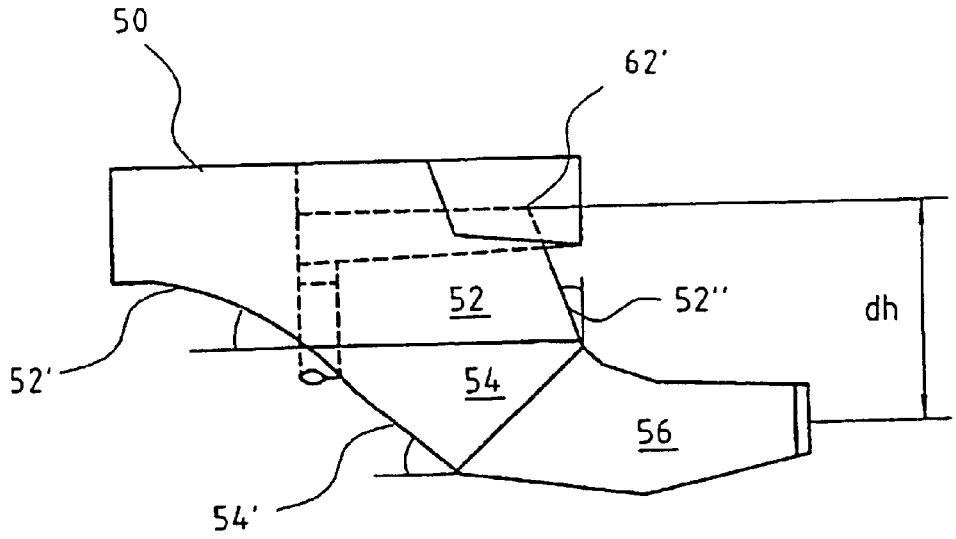
Figure 8:
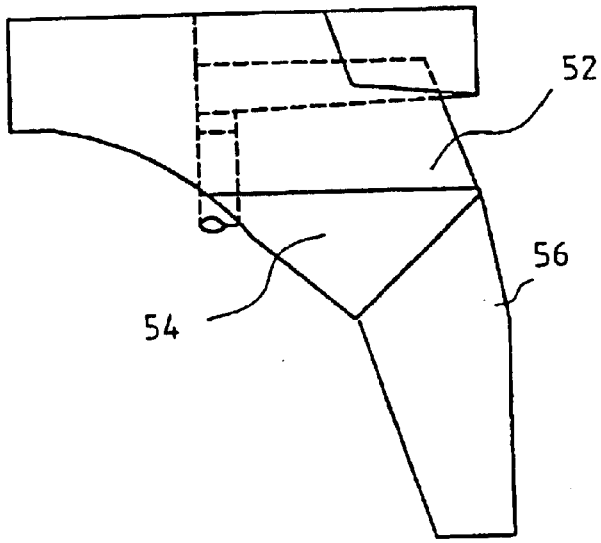
Figure 9A:
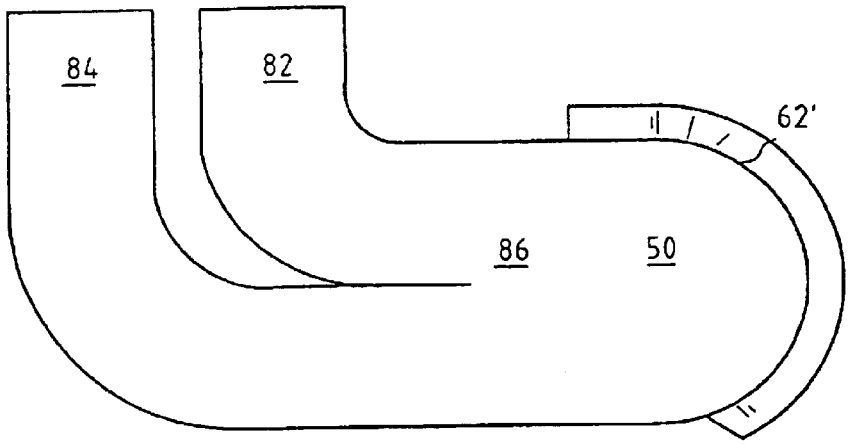
Figure 9B:
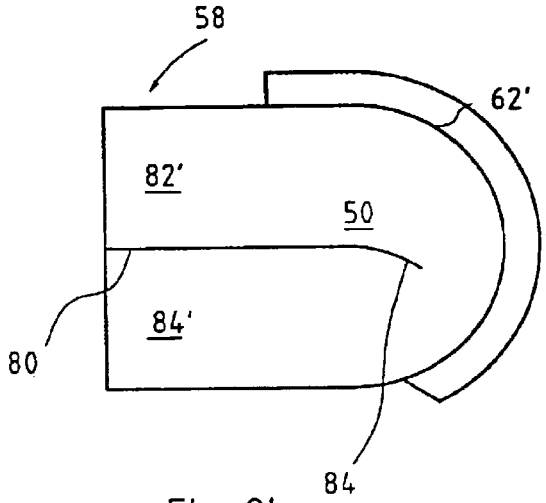

In the following, the wire pit according to the invention is described in more detail with reference to the appended figures, from which FIG. 1 illustrates a prior art paper machine head box approach system, FIG. 2 is a schematic illustration of another prior art solution, FIG. 3 illustrates a prior art wire pit, FIGS. 4, 5 and 6 illustrate a wire pit solution according to a preferred embodiment of the invention, FIG. 7 illustrates a preferred embodiment of the wire pit solution of FIGS. 4–6, FIG. 8 is a schematic illustration of a wire pit solution according to another preferred embodiment of the invention, and FIGS. 9*a* and 9*b* illustrate wire pit solutions according to a fifth and a sixth preferred embodiment of the invention.

The paper machine approach system illustrated in FIG. 1 comprises a white water tank or wire pit 10, a mixing pump 12, a centrifugal cleaning plant 14 with several stages, a gas-separaton tank 16 with its vacuum devices 17, a head box feed pump 18, a head box screen 20, a paper machine head box 22 and white water trays (not shown). Said components are arranged in connection with the paper machine 24 and arranged to operate as follows. The fiber material used in paper making, which may comprise fresh pulp, secondary pulp and/or broke, and the fillers which are diluted with so-called white water obtained from the paper machine, mostly from its wire section, are dosed from the machine chest via flow path 26 into the white water tank 10 to produce paper pulp, in which tank the white waters are collected and which in prior art systems is usually located at the bottom level of the mill as shown in the figure, to produce paper pulp. By means of a mixing pump 12 also located at the bottom level of the mill, said paper pulp is pumped from the white water tank 10 into a centrifugal cleaning plant 14 most usually comprising 4–6 stages and being usually located at the machine level K of the mill (the location level of the paper machine with its head box). The paper pulp accepted by the centrifugal cleaning plant 14 flows further under pressure created by said mixing pump 12, assisted by a vacuum of the gas-separation tank 16, into the gas-separation tank 16 located at level T above the machine level. The gas-separation tank 16 typically comprises an overflow, by means of which the surface level of the paper pulp in the tank is kept constant. The paper pulp discharged from tank 16 by means of the overflow flows via pipe 28 downwards into the white water tank 10 located at the bottom level of the mill below the machine level K. From the gas-separation tank 16, the essentially gas-free paper pulp, wherefrom gas has been removed as completely as possible by means of vacuum devices 17, flows to the head box feed pump 18 located at the bottom level of the mill, which feed pump pumps the paper pulp to the head box screen 20 also at the bottom level of the mill, wherefrom the accepted paper pulp flows to the machine level K into the paper machine head box 22. The feed pump 18 most commonly used is a centrifugal pump, although a propeller pump described in FI application 981798 is gaining popularity on the market. Especially the wire pit according to the present invention, when located at the machine level of the mill allows for the possibility to use a propeller pump described in said patent application.

FIG. 2 illustrates just the solution described in said FI patent application 981798. It is a new type of white water tank 100 located essentially at the machine level of the mill (the main part of the white water tank is above the machine level surface and the water surface is clearly above the machine level surface), into which fiber fractions are lead via pipe lines 40–44 and where the surface level is at $S_{100}$. The figure shows in phantom lines a prior art white water tank 10 located at the bottom level of the mill, most usually below the wire section of the paper machine, the surface level of which tank is at $S_{10}$, and a feed pump 12. In some cases the level difference between the surfaces $S_{100}$ and $S_{10}$ is several meters, especially in cases when the wire pit is located under the wire section of the paper machine, whereby the level difference may be directly calculated as additional consumption of pumping energy in a prior art system. Furthermore, a big-sized white water tank 10 causes an additional delay in the process. In the solution according to the figure, the level difference dh between the white water tank 100 and the gas-separation tank 16 is less than 9 meters, preferably less than 6 meters, suitably about 4 meters, whereby the required net positive suction head of the pump 120 is so small that it is quite possible to use a propeller pump.

FIG. 3 illustrates a further prior art wire pit solution. It comprises a cylindrical vessel 10 located vertically at the bottom level of the mill, at the upper part of which there is/are arranged one or more white water channel/s 30 via which the white waters flow into the wire pit essentially to the surface layer of the white water already existing therein. The surface level of liquid in the wire pit is kept constant by means of an overflow 32. The constant surface level ensures that an essentially constant hydrostatic pressure is always maintained at the bottom part of the wire pit. The upper part of the wire pit 10 is further provided with a cover 34 and a gas-removal conduit 36 therein, through which the gases separated from the white waters are directed out of the wire pit 10. Both a pipe 26 for thick pulp and pipes 28 for circulated liquids lead to the bottom part of the wire pit 10. These liquids, which are returned to the circulation, are obtained e.g. from the gas-separation tank overflow and the centrifugal cleaners as shown in FIG. 1.

FIGS. 4–6 show a wire pit 50 according to a preferred embodiment of the invention. The wire pit 50 comprises three main parts: an upper part 52, a middle part 54 and a lower part 56. The upper part 52 of the wire pit 50 comprises a chute portion 58 which is connected to one or preferably more white water channels (not shown) coming from the paper machine, and an overflow portion 60. A characteristic feature of the chute portion 58 in the embodiment of the figure is that it extends to the whole width of the wire pit, as shown in FIG. 4, and that it forms a part of the open gas-separation surface of the wire pit 50. The chute portion is relatively wide in such a way that its bottom descends towards the overflow portion. On the one hand, this is arranged because of the reason that by keeping the open surface of the wire pit preferably as wide as the open surface of prior art wire pits it is possible to ensure a sufficient gas-separation capability for the wire pit. On the other hand, by changing the wire pit construction, compared to prior art apparatuses, so that the bottom of the chute portion 58 is relatively near to the liquid surface, it is possible to reduce the volume of the wire pit 50 to minimum. Opposite the chute portion 58 at the upper part 52 of the wire pit 50 there is an overflow portion 60, which in the embodiment of the figure is about semi-circular. It has to be noted, though, that the proportion of the chute portion to the overflow portion may vary from the above mentioned even to a great extent. The overflow portion 60 may be considered to be formed of a wall 62 of the upper part 52 of the wire pit 50, the upper edge 62' of which wall determines the surface level of the liquid in the wire pit 50, and an overflow channel 64 located outside of it. One side of the overflow channel 64 is formed of said wall 62 of the wire pit, a bottom surface 66 and an outer side surface 68. The outer side surface 68 is preferably located higher than the wall 62 of the wire pit 50. In the embodiment of the figure, the bottom surface of the overflow channel 64 descends spirally towards an outlet conduit 70 for overflow liquid located at its other end. Naturally, the outlet conduit may be located at any location on the bottom of the overflow channel, whereby it is clear that the discharge from the bottom of the channel must always be arranged towards the conduit. A further characteristic feature of the upper part of the wire pit is that the height of the outer wall restricting the chute portion 58 at its sides is, according to a preferred embodiment of the invention, essentially the same as the height of the outer side surface of the overflow channel 64.

If desired, the wire pit may be provided with a cover and a conduit arranged is therein for leading gases out of the wire pit either directly to the atmosphere or to a special gas treatment A further characteristic feature of a preferred embodiment of the invention shown in FIGS. 4–6 is that the upper part 52 of the wire pit 50 formed of both the chute portion 58 and the overflow portion 60 preferably ends at a lower edge 72 provided with a flange, which lower edge is in a horizontal position and is preferably round, circular, or at least an equilateral polygon. Naturally, the upper edge 74, preferably also provided with a flange, of the middle part 54 of the wire pit 50 has just the corresponding shape. The purpose of said circularity or the corresponding form of equilateral polygon of the edges 72 and 74 is to ensure that the middle part 54 may be positioned in as many positions in relation to the upper part 52 as possible. It is, of course, possible to think of some rotatable joining methods, but they might not be justified for economical reasons. Just accordingly, the preferably flanged lower edge 76 of the middle part 54 has the shape of a circle or an equilateral polygon, as also the preferably flanged edge 78 of the lower part 56 on the side of the middle part 54. In that case, these parts may also be attached to each other in several different positions. According to an especially preferred embodiment of the invention, the conjunction surface of the middle part 54 and the lower part 56 is positioned in an angle of 45 degrees. The solutions of FIGS. 6 and 8 show the reason for the 45-degree angle. The cross-section of the wire pit 50 converges in the flow direction of the liquid as shown in the figures as evenly as possible towards the outlet opening of the lower part 56, which outlet opening is connected either directly or via an intermediate pipe to a mixing pump feeding the fiber suspension to the gas-separation device.

If the starting point in mounting the wire pit is that the white water chutes coming from the paper machine determine the position of the upper part 52 of the wire pit 50, the rotatability of the middle part 54 in relation to the upper part 52 to many angle positions makes it possible to direct the discharge of the wire pit 50 to different directions. Accordingly, the rotatability of the lower part 56 of the wire pit in relation to the middle part 54 to several different angle positions allows for further directing the discharge of the wire pit 50. Thus, adaptable construction of the wire pit 50 makes it possible to locate the mixing pump at the most practical location either at the machine level, at the bottom level of the mill or at some other suitable level.

As shown in FIGS. 4–6, each of the parts 52–56 of the wire pit 50 is made to converge towards the flow direction. Each part has been constructed most preferably from one or more conical parts, when possible. The aim of the construction is to maintain in the wire pit a flow as non-turbulent as possible in order to ensure a gas-separation as efficient as possible.

FIG. 7 illustrates a construction of the wire pit shown in more detail in FIGS. 4–6 according to a preferred embodiment of the invention. This figure concentrates especially on the positioning and direction of the walls of different parts of the wire pit. Firstly, in the experiments we have made we have noticed that the liquid flow discharging from the chute portion 58 of the upper part of the wire pit into the wire pit creates turbulence in the wire pit, which both decreases the gas-separation from the wire pit and disturbs the smooth flow of the liquid in the wire pit, unless the wall 52" of the wire pit is sloped both down- and outwards. In the experiments, the value of the angle a of FIG. 7 has been determined to be about 5–30 degrees, preferably 10–20 degrees. Accordingly, the slope angle b of the wall 52' positioned as an extension of the chute portion 58 has been determined in the experiments to be 20–45 degrees, preferably 25–35 degrees, although this angle is to some extent less significant in view of the total flow than the value of the angle a discussed above. Nevertheless, if the angle b is too big, turbulence circulating upwards is formed in the vicinity of the wall, which naturally decreases the flow characteristics of the wire pit. A third angle to be taken into account is the slope angle g of the middle part wall 54, which preferably is in the order of 45 degrees, although it may vary, depending on the dimensioning of the wire pit, between 35–55 degrees. The figure shows as one more preferable method of dimensioning the wire pit the height dh of the center line of the discharge opening of the lower part of the wire pit from the wire pit surface. During the experiments we have noticed that the best result in view of both the volume of the wire pit and its gas-separation capability, which as such have an opposite effect, is reached when the height dh alters between 2–5× the diameter of the discharge opening, preferably about 3 times the diameter of the discharge opening. The diameter of the discharge opening, in its turn, usually varies between 400–1000 mm, although, naturally, smaller and bigger dimensions may be applied in special cases. A further dimensioning principle for the wire pit may be considered to be that the flow velocity of the liquid in the wire pit essentially at the surface level thereof is in the order of 0.10–0.15 m/s, wherefrom it is smoothly increased by minimizing the volume of the wire pit to a velocity of about 1.5 m/s.

FIG. 8 illustrates a wire pit solution according to a second preferred embodiment of the invention e.g. for situations where the wire pit according to the invention is used to substitute a prior art wire pit located at the bottom level of the mill. In the solution of FIG. 8, the lower part 56 of the wire pit 50 has been turned compared to the solution of FIG. 6 by 180 degrees, whereby the lower part is directed straight downwards and may be connected to the mixing pump by means of a traditional pipe elbow.

According to a third preferred embodiment of the invention, the wire pit comprises two parts only. Compared to the solutions of FIGS. 4–7, the difference is that in this embodiment the upper and middle parts of the wire pit of FIGS. 4–7 have been constructed stationary, whereby only the lower part of the wire pit may be positioned in different angle positions in relation to the upper part. This mainly allows for using one and the same wire pit together with a mixing pump located either at the machine level or at the bottom level.

According to a fourth preferred embodiment of the invention, also, the wire pit comprises two parts only. Compared to the solutions of FIGS. 4–7, the difference is that in this embodiment the middle and lower parts of the wire pit of figures 4–7 have been constructed stationary, whereby only the upper part of the wire pit may be positioned in several different angle positions in relation to the lower part. This mainly allows for using one and the same wire pit with a mixing pump located at various directions at the machine level.

FIGS. 9*a* and 9*b* illustrate solutions according to a fifth and a sixth preferred further embodiment of the invention. In the solutions of the figures, the white waters entering the wire pit have been separated to at least two parts based on the fiber material or solid material entrained therein. It is of course possible to utilize several white water introduction channels, if desired, but most often two channels are enough. In the embodiment of FIG. 9*a*, white waters are lead to the chute portion 58 of the wire pit 50 via at least two channels 82 and 84 so that the white water flowing via channel 82 is obtained from further from the head box than the white water flowing via channel 84. Thus, the white water flowing via channel 84 contains more solids and fibers than the white water in channel 82. At the chute portion, the white waters of both channels 82 and 84 are joined in one channel 86, in which the white waters are maintained as separate flows to such an extent that the cleaner white water from channel 82 is passed to the overflow edge, whereby material with lower solids-content is passed to further treatment therethrough. In the embodiment of FIG. 9*b*, the chute portion 58 leading the white waters into the wire pit 50 has been divided by an intermediate wall 80 to two parts 82' and 84', into the first part 82' of which the white waters recovered from further from the head box are lead, which white waters have a low fiber and solids content. The other part 84' receives the more fiber and solids-containing part of the white waters, i.e. those obtained from closer to the head box. Another difference compared to the wire pit described before is a deflector 86 arranged at the upper part of the wire pit essentially the level of the liquid surface, the purpose of which deflector is to guide the white water containing more fiber and solids material to the middle part of the wire pit. Thus the fraction that contains the lowest amount of fibers and solid material is passed along the edge of the wire pit, which means that the part of the white water that contains less fibers and solid material flows to the overflow. Both solutions lead to essentially decreased fiber losses compared to previous methods, as the cleanest fraction flows to white water filtration and fiber recovery.

A further construction solution worth mentioning is a new type of wire pit embodiment arranged in connection with an older paper machine. That is to say, the starting point is a situation where the old wire pit and mixing pump are located at the bottom level of the mill i.e. below the machine level. When changing the location of pulp pipes leading to the mixing pump and the lower part of the wire pit is not desired, the new wire pit must be located at the bottom level of the mill, too. But, in order to fully utilize the possibilities offered by the wire pit according to the invention, the wire pit to be used is either that of FIG. 7 or, as an alternative, that of FIGS. 4–6 located at the bottom level. This latter alternative may be carried out so that the wire pit is located at the bottom level and the white waters directed therein are introduced preferably via several drop legs to the chute portion of the wire pit. In other words, it is preferable to arrange several drop legs which introduce white waters having various solids or fiber contents to the chute part of the wire pit, wherefrom they may be lead further into the wire pit itself e.g. according to FIGS. 9*a* and 9*b*.

A further possible construction stabilizing the operation of the wire pit according to the invention is the use of one or more flow deflectors positioned in flow direction and arranged inside some part of the wire pit, i.e. either the upper part, the middle part or the lower part, which deflectors do not disturb the flow, but only prevent turbulence which might occur therein. Naturally it is clear that said deflectors may also form a lattice construction which prevents turbulence on several levels.

Finally, it is worth noticing that despite the fact that in prior art systems the liquid removed from the wire pit via the overflow has always been returned to circulation via the white water filter, whereby the white water filter has separated usable fiber material from the liquid discharged at the overflow, the very same arrangement has called for the necessity to use a relatively large white water filter, because in some cases large amounts of fiber-containing liquid are passed to the overflow. But this invention presents the use of a fiber-recovery device arranged in connection with the wire pit overflow, which device may be e.g. a curved screen. In such a case the recovered fiber fraction is quickly returned to the short circulation, e.g. into the wire pit, and the cleaner liquid is lead e.g. to the white water process. Said fiber recovery device may even be arranged as a constructional part of the wire pit, whereby the space demand of fiber recovery remains as small as possible. Advantages of the prescribed solution are, e.g., quick recirculation of fiber fraction back to the process and decreased loading of the white water fiber recovery due to the fact that most part of the fiber fraction has already been removed from the white water discharged at the overflow.

Further, it is to be noticed that it is preferable to arrange in the wire pit an inlet conduit for makeup liquid, through which it is possible to introduce make-up liquid into the wire pit in cases when the surface level in the wire pit tends to lower, i.e. when less white waters are obtained than pumped further from the bottom part of the wire pit. The mentioned make-up liquid introduction requires a device monitoring the surface level of the wire pit, which device opens the make-up liquid inlet valve when the surface level in the wire pit tends to lower.

Except for removal of surplus liquid by means of overflow, the wire pit may also be provided with a discharge conduit for excess liquid and a valve arranged in connection therewith, which valve opens when receiving from a level indicator a signal on the rising of the surface level. That is, the overflow may be substituted by a discharge conduit, whereby it is possible to arrange in connection therewith separation of fibers from the overflow liquid which has been described earlier in this application.

As noticed from the above, a new type of wire pit and apparatus for the paper machine approach system have been developed, which eliminates many disadvantages and weaknesses of prior art and solves problems which have been hampering the use of prior art approach systems.

What is claimed is:

1. Wire pit for an approach system of a web formation machine comprising:

a chute located in an upper portion of the wire pit for receiving white water, wherein said chute forms a lower surface of the upper portion of the wire pit, an overflow portion adjacent said chute for stabilizing a surface level of the white water in the wire pit, a gas separator for separating gas from the white water, and a lower portion downstream of the upper portion and said lower portion having an outlet connectable to a mixing pump, wherein at least one wall of the wire pit converges downwardly to provide flow direction of the liquid through the wire pit which deviates from vertical.

2. A wire pit according to claim 1 wherein the upper portion of the wire pit has walls sloped downwards and outwards.

3. A wire pit according to claim 1, wherein said chute is divided into to at least two flow paths for white water streams having different fiber contents.

4. A wire pit according to claim 1, wherein said chute includes a plurality of flow paths for white water streams having various fiber contents.

5. A wire pit according to claim 1, wherein the overflow portion includes an upper edge of a wall of the wire pit.

6. A wire pit according to claim 3, wherein said chute is connected in a downstream direction to a deflector which directs a flow of white waters having a higher fiber content to a zone of the wire pit distant from the overflow portion.

7. A wire pit according to claim 1, wherein a wall of the wire pit is located adjacent the chute, and said wall is sloped downwards and outwards at an angle in a range of 5 degrees to 30 degrees from horizontal.

8. A wire pit according to claim 1, wherein a wall of the wire pit extends from chute in a flow direction, and said wall descends at an angle in a range of 20 degrees to 45 degrees from horizontal.

9. A wire pit according to claim 3, wherein the overflow portion or a flow channel downstream of the overflow portion includes a fiber fraction separator for separating fiber from overflow liquid.

10. A wire pit according to claim 9, wherein said fiber fraction separator is a curved screen or pressure screen.

11. A wire pit according to claim 1, wherein said gas separator is at the upper portion of the wire pit.

12. A wire pit according to claim 1, further comprising walls having an inside surface including at least one deflector positioned in a flow path through the pit.

13. A wire pit for an approach system of a web formation machine comprising:

a chute located in an upper portion of the wire pit for receiving white water, an overflow portion adjacent said chute for stabilizing a surface level of the white water in the wire pit, a gas separator for separating gas from the white waters, and a lower portion downstream of the upper portion and said lower portion having an outlet connectable to a mixing pump, wherein at least one wall of the wire pit converges downwardly to provide flow direction of the liquid through the wire pit which deviates from vertical, and wherein the wire pit has a flow path cross-section converging in a flow direction, and the lower portion is adjustable to a plurality of angular positions in relation to said upper portion.

14. A wire pit according to claim 13, wherein the wire pit further comprises a middle portion located between said upper portion and lower portion, and the middle portion is adjustable to a plurality of angular positions in relation to at least one of said upper portion and said lower portion.

15. A wire pit according to claim 13, wherein the lower portion is connectable to the mixing pump.

16. A wire pit, for an approach system of a web formation machine comprising:

a chute located in an upper portion of the wire pit for receiving white water, an overflow portion adjacent said chute for stabilizing a surface level of the white water in the wire pit, a gas separator for separating gas from the white water, and a lower portion downstream of the upper portion and said lower portion having an outlet connectable to a mixing pump, wherein at least one wall of the wire pit converges downwardly to provide flow direction of the liquid through the wire pit which deviates from vertical wherein said chute forms a bottom of the upper portion of the wire pit wherein a wall of the wire pit extends from chute in a flow direction, and said wall descends at an angle in a range of 20 degrees to 45 degrees from horizontal, and wherein downstream of said wall the wire pit further comprises a middle portion between said upper portion and lower portion, and a wall of said middle portion descends at an angle of 35 degrees to 55 degrees from horizontal.

17. A wire pit for an approach system of a web formation machine comprising:

a chute located in an upper portion of the wire pit for receiving white water, an overflow portion adjacent said chute for stabilizing a surface level of the white water in the wire pit, a gas separator for separating gas from the white water, and a lower portion downstream of the upper portion and said lower portion having an outlet connectable to a mixing pump, wherein at least one wall of the wire pit converges downwardly to provide flow direction of the liquid through the wire pit which deviates from vertical, wherein said chute is divided into to at least two flow paths for white water streams having different fiber contents, and wherein at least 50% of the overflow portion is in a zone containing a pulp fraction flow with a lower fiber content.

18. A wire pit for an approach system of a web formation machine comprising:

a chute located in an upper portion of the wire pit for receiving white water, an overflow portion adjacent said chute for stabilizing a surface level of the white water in the wire pit, a gas separator for separating gas from the white waters and said gas separator is at the upper portion of the wire pit, and a lower portion downstream of the upper portion and said lower portion having an outlet connectable to a mixing pump, wherein at least one wall of the wire pit converges downwardly to provide flow direction of the liquid through the wire pit which deviates from vertical, wherein the overflow portion has an overflow edge, and a height of the overflow edge, measured from a center line of the outlet opening of the lower portion of the wire pit, is in a range of two to five times a diameter of the outlet opening.

* * * * *